US006067431A

United States Patent [19]

Bakker

[11] Patent Number: 6,067,431

[45] Date of Patent: May 23, 2000

[54] SUPPLY MEANS FOR SUPPLYING MAGNETICALLY ATTRACTIVE DEVELOPING POWDER

[75] Inventor: Robert Eric Bakker, Venlo, Netherlands

[73] Assignee: Océ-Technologies B.V., Ma Venlo, Netherlands

[21] Appl. No.: 09/205,294

[22] Filed: Dec. 4, 1998

[30] Foreign Application Priority Data

Dec. 4, 1997 [NL] Netherlands ..... 1007688

[51] Int. Cl.[7] ..... G03G 15/08

[52] U.S. Cl. ..... 399/252; 399/258

[58] Field of Search ..... 222/425, DIG. 1; 399/234, 252, 258

[56] References Cited

U.S. PATENT DOCUMENTS

| | | | |
|---|---|---|---|
| 4,252,434 | 2/1981 | Nakamura et al. | 399/358 |
| 4,380,309 | 4/1983 | Takahashi et al. | 222/DIG. 1 |
| 5,181,074 | 1/1993 | Memoto et al. | 399/234 |

OTHER PUBLICATIONS

Patent Abstract of Japan of Japanese Publication No. 58–122572.

Patent Abstract of Japan of Japanese Publication No. 3–177863.

*Primary Examiner*—Arthur T. Grimley

*Assistant Examiner*—William A. Noē

*Attorney, Agent, or Firm*—Birch, Stewart, Kolasch & Birch, LLP

[57] ABSTRACT

The invention relates to a supply means for magnetically attractive developing powder. The supply means includes a reservoir having an outflow opening for supplying a magnetically attractive developing powder from the reservoir to a developing unit. The reservoir is provided with two magnetic systems each rotatable about an axis of rotation and each at least partially being surrounded by a stationary enclosure over which the developing powder can be displaced under the influence of the rotating magnetic systems. The magnetic systems are disposed opposite to one another with the axes of rotation parallel to one another. The stationary enclosures of the two magnetic systems together form the outflow opening. While in a supply mode, the magnetic systems are adapted to effect transport of developing powder through the outflow opening by rotation and in a stationary mode the magnetic systems are adapted to prevent transport of developing powder through the outflow opening.

20 Claims, 3 Drawing Sheets

SUPPLY MEANS FOR SUPPLYING MAGNETICALLY ATTRACTIVE DEVELOPING POWDER

BACKGROUND OF THE INVENTION

1. Field of the Invention

The invention relates to a means for supplying magnetically attractive developing powder, comprising a reservoir provided with an outflow opening and a magnetic system for supplying the magnetically attractive developing powder from the reservoir to a developing unit.

2. Description of Related Art

A supply means of this kind is known from U.S. Pat. No. 5,181,074, wherein a developing device is described for a developing powder made of toner and carrier particles. The carrier particles are magnetically attractive. In this device, the developing powder is transported to a supply unit.

The underside of the supply unit is closed by a magnetic roller. Rotation of the magnetic roller causes developing powder to be supplied to a mixing chamber of a developing unit, which is located in an electro-photographic printing unit. The mixing chamber is located beneath the supply unit.

In the practice of this device, it has been found that the quantity of developing powder that can be supplied is limited, even in the case of developing powder consisting solely of magnetically attractive toner. For example, when such so-called one component or unary toner is used, a supply speed of 30 to 35 grams per minute is the maximum obtainable. This quantity of toner is insufficient for copiers and printers operating at very high speeds (in excess of 100 copies or prints per minute).

Other methods of supplying large quantities of toner rapidly, for example using rotating mechanical valves, have the disadvantage that the supply toner comes into contact with the mechanical valves. This is a disadvantage when using toners which have been developed and are available today. These toners generally have relatively low fusing properties, i.e. the toner is fixed on the paper at a relatively low temperature. This is advantageous with regard to the energy required to fix the toner on the paper; however, these toners have a disadvantage in that they are mechanically vulnerable.

Lumping or caking of the toners occurs rapidly due to the mechanical load. This results in an unacceptable distortion of the image. The advantage of using a magnetic system such as a magnetic roller for supplying magnetically attractive toner or a toner-carrier mixture is that the toner is subjected to a low mechanical load. As a result, caking is avoided as much as possible.

BRIEF SUMMARY OF THE INVENTION

The present invention achieves the above objects by a reservoir provided with two magnetic systems, each system being rotatable about an axis of rotation. In addition, each system is at least partially surrounded by a stationary enclosure over which the developing powder can be displaced under the influence of the rotating magnetic systems. The magnetic systems are disposed opposite one another with their axes of rotation parallel to one another. The stationary enclosures of the two magnetic systems together form the outflow opening. When the magnetic systems are in a supply mode, the magnetic systems effect transport of developing powder through the outflow opening by rotation. When the magnetic systems are in a stationary mode, the magnetic systems prevent transport of developing powder through the outflow opening.

With this system, it is possible to supply large quantities of developing powder while avoiding caking due to mechanical loading. Supply takes place during the rotation of the magnetic rollers.

If the developing powder used is relatively strongly magnetizable and/or has poor flowing properties, according to a first embodiment of the present invention, the outflow opening is located beneath the reservoir in an operative state and the direction of rotation of the magnetic system in the supply mode coincides with the developing powder supply direction. In the stationary mode, the strongly magnetizable developing powder forms a developing powder bridge extending across the outflow opening, so that the transport of the powder is prevented. In the supply mode this bridge is broken because the developing powder is drawn through the outflow opening by the rotating magnetic systems.

If the developing powder used is relatively weakly magnetizable and/or has good flowing properties, according to a second embodiment of the invention, the outflow opening is located beneath the reservoir in an operative state and the direction of rotation of the magnetic systems in the supply mode is in the opposite direction to the developing powder supply direction. With developing powder of this kind, passage of the developing powder through the outflow opening will occur when the magnetic systems are stationary. Passage of developing powder is increased, and a large supply is obtained, when the magnetic systems are rotated in a direction opposite the direction of developing powder supply.

Another advantageous embodiment of the present invention includes each magnetic system having on an outside thereof, two diametrically opposite magnets extending in parallel to the axis of rotation. In addition, the connecting line between the magnets of one magnetic system is substantially perpendicular to the connecting line between the magnets of the other magnetic system when a magnet is situated opposite the outflow opening.

One effect of this above-described embodiment is that the magnetic field between the magnetic poles is reduced, so that developing powder can drop from the enclosure to the developing device. Furthermore, more than two magnets per magnetic system gives an increased chance of complete coverage of the enclosure with developing powder. On the other hand, during rotation, a separate magnetic pole comes along the outflow opening four times per revolution during rotation. This magnetic system entrains developing powder without magnets being situated opposite to one another.

Another advantageous embodiment of the present invention includes one of the magnets situated opposite the toner outflow opening when in the stationary mode. In the case where developing powder is used which is weakly magnetically attractive and/or has good flowing properties, with no spontaneous bridge formation occurring, the passage of developing powder can be prevented.

In another advantageous embodiment of the present invention, the reservoir is provided with means contained therein for keeping the developing powder loose, this means being inoperative in the stationary mode and operative in the supply mode.

Particularly in the case of strongly magnetizable toner and/or developing powder which has poor flowing properties, the above-mentioned bridge formation in the stationary mode can be so great that the connection between the developing powder particles has to be broken before the magnetic systems can transport them.

One advantageous embodiment for the purpose of achieving a large supply includes the stationary enclosure of the magnetic systems defining the outflow opening merging, via a transition surface extending at a continuous angle of inclination into a straight outflow duct. The transition surface tangentially adjoins that part of the enclosure which forms the outflow opening and the outflow duct. The developing powder transported by a first magnetic pole must be given the opportunity to remain out of the influence of a following magnetic pole of the opposite magnetic system. Otherwise the transported developing powder will again be drawn back by the next magnetic pole. As a result of the shape of the transition surface, the developing powder can flow out rapidly so that a higher speed of revolution of the magnetic system is possible.

Another advantageous alternative embodiment for obtaining a large supply is obtained for the above-mentioned reasons in an embodiment wherein the stationary enclosure of the magnetic system defining the outflow opening merges, via a straight transition plane having a constant angle of inclination, into a straight outflow duct. The transition plane tangentially adjoins the part of the enclosure forming the outflow opening.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
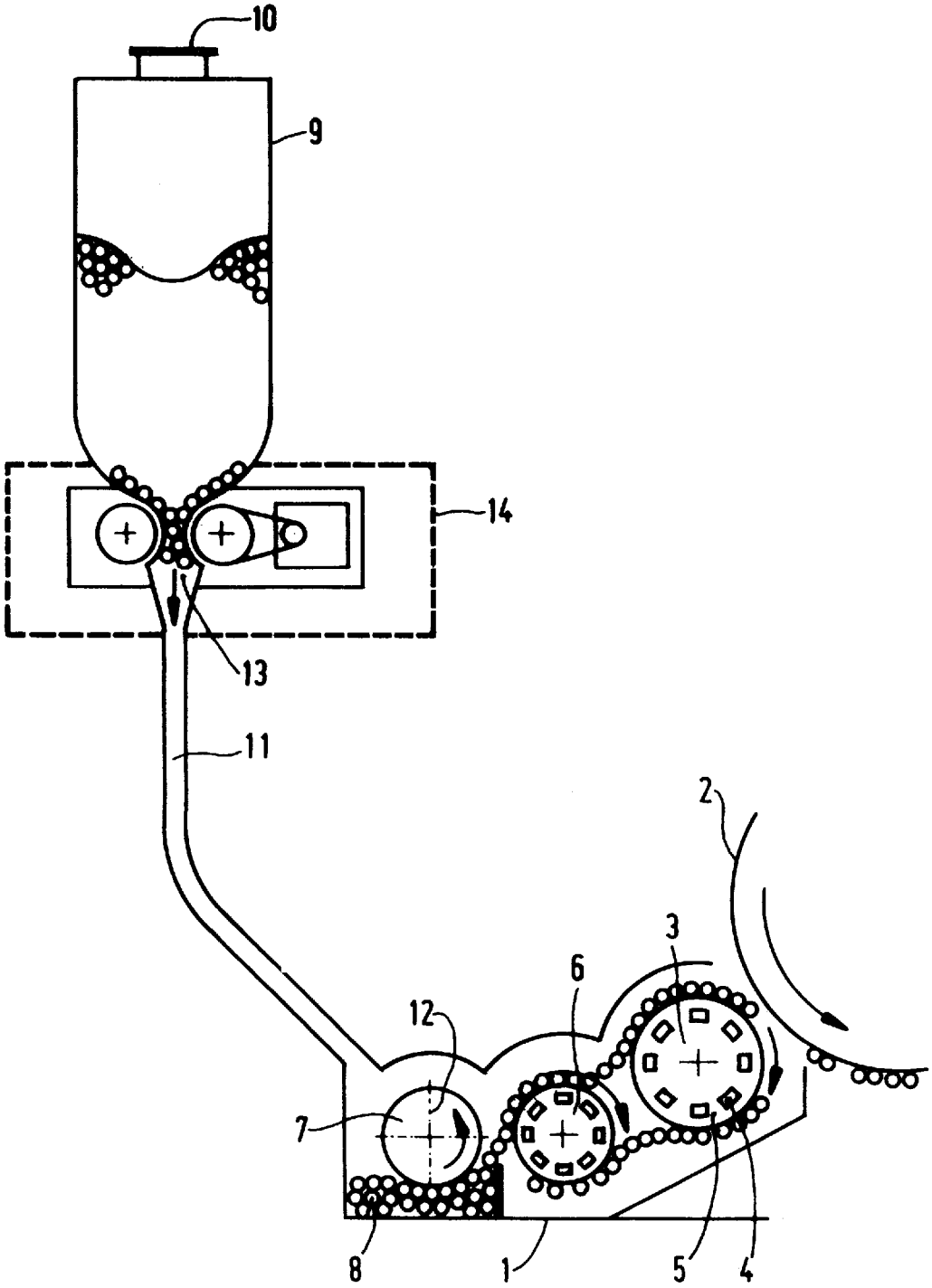
FIG. 1 shows a developing unit with a supply means according to the present invention.

FIG. 1 diagrammatically illustrates a developing unit 1 for developing a developing paper image on a charge carrier 2 of the kind used in copying machines or laser or LED printers. For this purpose, the charge carrier 2 is provided with photoconductive or dielectric material. In the case of photoconductive material, a charge image is obtained on the charge carrier 2 by means of direct image exposure as in the case of conventional or analogue copying machines. In the case where digital copying apparatus or printers are used, a charge image is obtained by means of a laser or LED exposure. Local developing powder is adapted to be deposited on the charge image by the developing unit 1. In the case where dielectric material is used, a charge image is obtained by an electrode system suitable for the purpose. The developing powder can be of the unary conductive type with only toner, or of the binary type in the form of a combination of carrier and toner. Both types of toner adhere electrically to the charge present on the charge carrier 2. Unary toner comprises magnetizable material to enable the same to be applied to the charge carrier 2 by means of a magnetic developing roller 3. In the description hereinafter, for the sake of convenience the term "toner" will be used to indicate different types of developing powder. For application purposes, the developing roller 3 comprises a number of magnets 4, a sleeve 5 trained around the same rotating in the direction indicated. The magnets 4 ensure that the toner is attracted to the sleeve 5, while the sleeve 5 ensures the transport of the toner. Suitable feed means such as a similar magnetic intermediate roller 6 and a mechanical feed roller 7 with blades or wires 12 ensure transport of the toner from a reservoir space 8 to the developing roller 3.

The reservoir space 8 is filled with toner from a toner reservoir 9 having sufficient capacity to make a required number of copies or prints. The toner reservoir 9 can be constructed as an exchangeable bottle or as a fixed reservoir which can be replenished via a filling opening 10. The capacity required for such a toner reservoir 9 will be in the region of 1 to 2 liters, for example. The toner reservoir 9 is connected to the developing unit 1 via a tube or flexible hose 11. The toner can be moved by means of spirals in the tube 11, but movement is preferably effected by gravity in order to avoid mechanical loading of the toner as much as possible.

Preferably, known means for keeping the toner loose are provided in the toner reservoir 9, although not shown in detail. Such means may, for example, be a mixer mill having a rotating set of mixer wires disposed at a specific angle, and located a short distance away from the wall. These prevent the toner from caking or eliminate any caking after long stationary periods. Such means also provide for mixing of old and new toner.

Referring to FIG. 1, a toner reservoir 9 with the toner outflow opening 13 extending downwardly, comprises a toner supply means 14. The toner supply means 14 can prevent unwanted passage of toner to the developing unit 1 and can supply a required predetermined quantity of toner to the developing unit 1. The supply means 14 must be capable of supplying a required quantity of toner per unit of time on the order of 50 to 100 grams per minute. Such quantities are in fact required for copying machines and printers making more than 100 copies per minute. However, the supply means must exert the minimum possible mechanical loading on the toner in order to avoid lumping or damage of the toner.

Figure 2:
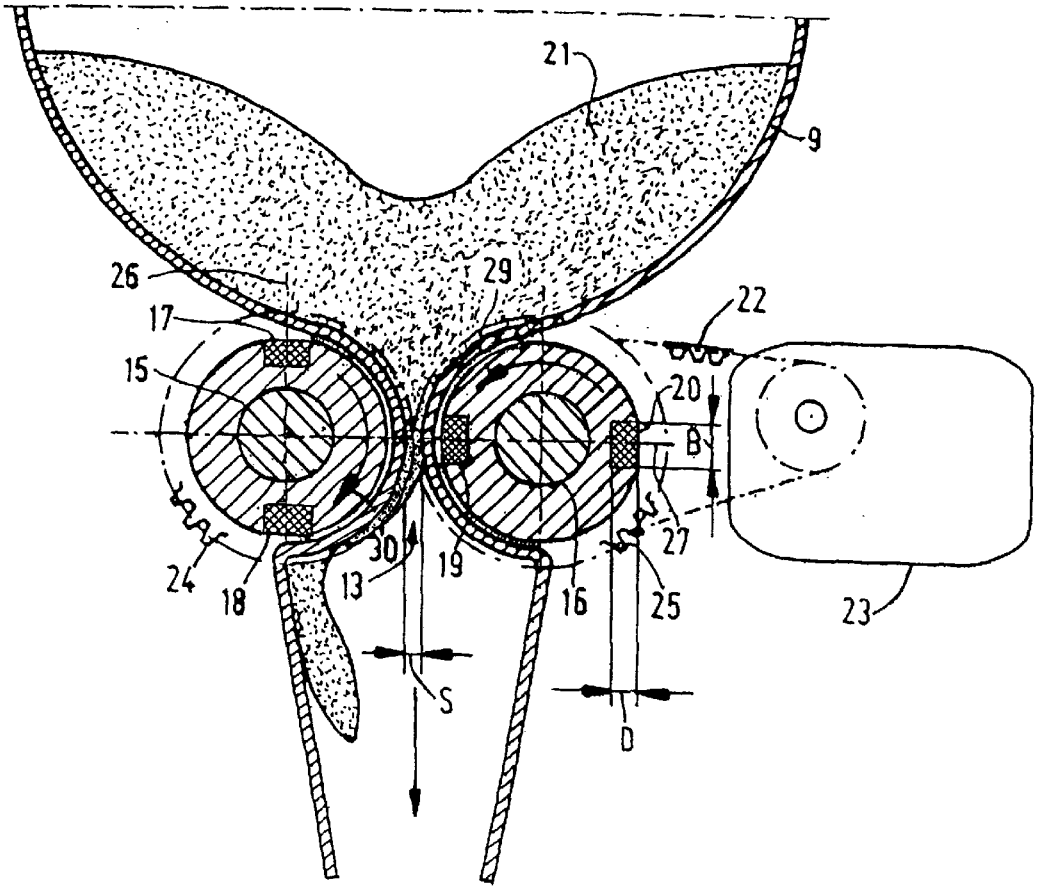
FIG. 2 shows the supply means of FIG. 1 in accordance with a first embodiment of the present invention.

FIG. 2 shows the toner supply means 14 of FIG. 1 in greater detail in accordance with a first embodiment of the present invention. FIG. 2 shows two magnetic rollers 15 and 16 comprising bar magnets 17, 18, 19 and 20. The magnets 17–20 have a magnetic strength of about 3400 Gauss and a dimension of 50 mm in the direction of the longitudinal axis of the magnetic rollers. The width B is 6 mm and the thickness D is between 3 and 6 mm. By varying the thickness D it is possible to adjust the effective magnetic force exerted on the toner. The pole-pole directions of the magnets 17 and 18, and 19 and 20 pass through the axis of the magnetic rollers 15 and 16, respectively.

The magnetic rollers 15 and 16 are partly closely enclosed by part of the toner reservoir 9, a toner outflow opening 13 being formed with a minimum gap width S of 0.5 to 2 mm. It must be remembered that the toner has characteristic cross-sections of about 10 $\mu$m. The magnetic forces exerted by the magnets 17–20 are operative on the toner 21 in the toner reservoir 9 located near said magnets 17–20. The size of the toner outflow opening 13 in the axial direction of the magnetic rollers 15 and 16 corresponds to the length of the magnets 17–18 and is 50 mm.

Although the magnetic rollers 15 and 16 are in this case constructed as rollers of non-magnetic material with the separate magnets 17–20 embedded therein, a magnetic roller can also be constructed in the form of a magnetized roller of magnetic material. It should also be noted that the enclosure forming the toner outflow opening 13 is of course not of magnetic or magnetizable material.

A gearwheel 24 is fixed to the magnetic roller 15 and a gearwheel 25 to the magnetic roller 16. Gearwheel 25 is driven by a motor 23 via a toothed drive belt 22. The gearwheels 24 and 25 are also coupled so that the connecting line 26 between the magnets 17 and 18 is always perpendicular to the connecting line 27 between the magnets 19 and 20. As a result, a magnetic pole comes along the toner outflow opening 13 four times per revolution. The variations in the mechanical load of the drive are acceptable in this case. The magnetic rollers 15 and 16 are driven at a speed of between 50 and 175 revolutions per minute, depending on the required amount of toner to be supplied.

In the case of toner which is relatively strongly magnetizable and/or has poor flowing properties, a toner bridge will be formed across the toner outflow opening 13 when the magnetic rollers 15 and 16 are stationary, so that no toner is supplied. In the stationary mode, the abovementioned means for keeping the toner loose in the toner reservoir 9 are not active so that the bridge that has been formed is not destroyed. However, by rotating the magnetic rollers 15 and 16 in the directions 29 and 30 shown in FIG. 2 in the toner supply direction, by means of a motor 23, toner is displaced through the toner outflow opening 13. The toner loosening means are now also activated in order to break the bridge that has been formed. The toner is attracted to the wall of the toner reservoir 9 in the form of a brush. Therefore, the toner rolls and/or slides over the wall as a result of the force of attraction of the rotating magnetic fields. In this case, the maximum quantity of toner to be supplied is determined primarily by the maximum speed of rotation at which complete toner coverage of the parts of the toner reservoir 9 adjoining the magnetic rollers 15 and 16 is obtained. However, in order for the toner to be supplied, the toner must have time to drop by gravity before the next rotating magnet again engages the toner. Until this maximum speed of rotation is reached, the quantity of supplied toner increases with an increase in the speed of rotation of the magnetic rollers 15 and 16. With a gap width S of about 2.5 mm there is also complete coverage with toner.

On the other hand, for complete supply, the gap width S must not be less than about 0.5 mm. Toner supplies of more than 50 g per minute are obtained with gap widths S between 1 mm and 2 mm at a speed of the magnetic rollers 15 and 16 in excess of 100 rpm. Within these limits, the toner supply increases with the use of stronger magnets to a maximum of 90 g per minute at 150 rpm.

Figure 3:
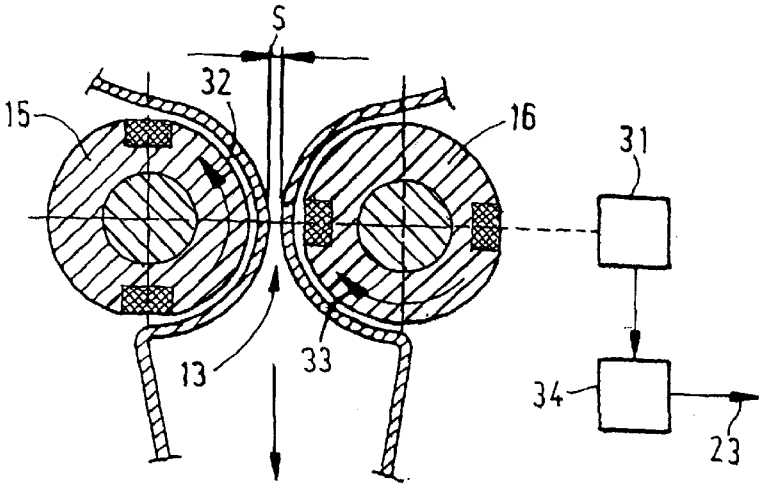
FIG. 3 shows the supply means of FIG. 2 in accordance with a second embodiment of the present invention.

In the case of relatively weakly magnetizable toner and/or toner having good flowing properties, the situation that occurs is different. This situation occurs when using color toner, for example, in which the percentage of magnetic material is preferably kept as low as possible. In this case, when the rollers are in a stationary mode, no toner bridge is formed. The toner will therefore run spontaneously through the toner outflow opening 13 if there is no magnetic pole situated near the toner outflow opening 13. Consequently, in a second embodiment of the present invention, the magnetic rollers 15 and 16 in the stationary mode are positioned so that there is always one magnetic pole opposite the toner outflow opening 13. This can be achieved by known position sensors such as magnetic sensors or optical sensors in combination with a marker on one of the gearwheels 24 and 25. In FIG. 3 this is shown by a sensor 31 which controls the motor 23 via a control circuit 34.

The maximum gap width is determined in this case by spontaneous passage of the toner while the minimum gap width is determined by the minimum supply required. In practice, the gap width S for a supply greater than 50 g per minute is between 1.3 mm and 1.9 mm for a gap length of 50 mm.

Also, with such weakly magnetizable toner, the magnets of the magnetic rollers 15 and 16 are unable to attract the toner over the surrounding wall of the reservoir 9. However, by rotating the magnetic rollers 15 and 16 in the upward direction, opposite to the toner supply direction, in the directions indicated by the arrows 32 and 33 in FIG. 3, the spontaneous passage of the toner is intensified. Therefore, for a speed of rotation of more than 100 rpm, a toner supply of more than 50 g per minute can be achieved up to a maximum of 80 g per minute for a speed of rotation of 150 rpm.

Figure 4:
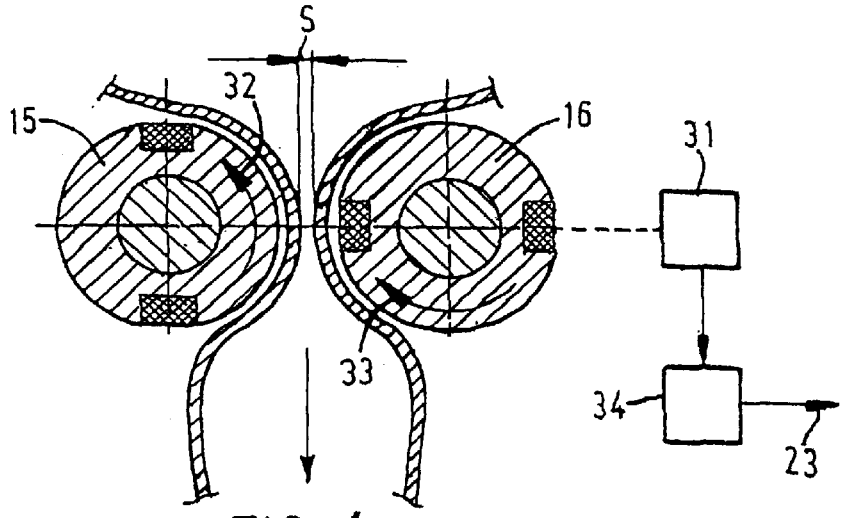
FIG. 4 shows a first embodiment of the outflow opening of the supply means.

FIG. 4 is a more detailed embodiment of the advantageously formed transition plane 35 from the toner outflow opening to a further toner transport conduit. As already stated, the transported toner must come out of the range of a following rotating magnet as quickly as possible. As a result of the transition surface 35, which extends in a continuous angle of inclination, the toner does not stop and the required distance is achieved more quickly.

Figure 5:
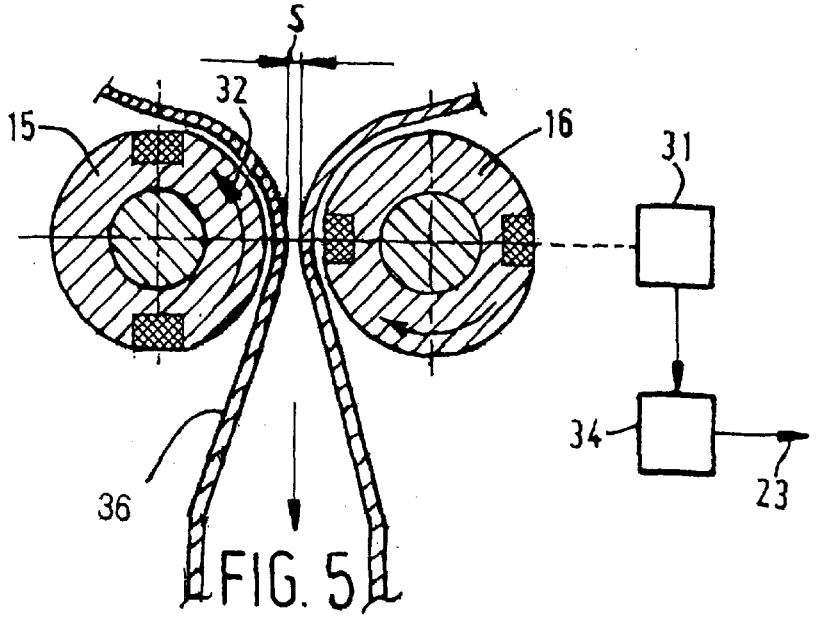
FIG. 5 shows a second embodiment of the outflow opening of the supply means.

FIG. 5 shows another advantageous form of a transition plane 36 between the toner outflow opening and a further toner transport conduit. In this case the angle of inclination of the transition plane 36 is constant and it tangentially adjoins the toner outflow opening and the toner transport conduit.

A greater supply of toner can be obtained with the shape of the transition surface 35 and the transition plane 36 shown in FIGS. 4 and 5.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A supply means for magnetically attractive developing powder, comprising:

a reservoir having an outflow opening for supplying a magnetically attractive developing powder from the reservoir to a developing unit;

the reservoir is provided with two magnetic systems, each rotatable about an axis of rotation, and each at least partially surrounded by a stationary enclosure under the influence of the rotatable magnetic systems;

the magnetic systems are disposed opposite one another with their axes of rotation parallel to one another;

the stationary enclosures of the two magnetic systems together form the outflow opening; and wherein, when in a supply mode, the magnetic systems effect transport of developing powder through the outflow opening by rotation; and, when in a stationary mode, the magnetic systems prevent transport of developing powder through the outflow opening.

2. A supply means according to claim 1, wherein the outflow opening is located beneath the reservoir in an operative state, and the direction of rotation of the magnetic systems in the supply mode coincides with the developing powder supply direction.

3. A supply means according to claim 2, wherein each magnetic system includes two diametrically opposed magnets on an outside thereof, said magnets extending parallel to the axis of rotation, and wherein a connecting line between the magnets of one of the magnetic systems is substantially perpendicular to a connecting line between the magnets of the other of the magnetic systems when a magnet is situated opposite the outflow opening.

4. A supply means according to claim 2, wherein the reservoir is provided with means contained therein for keeping the developing powder loose, said means being inoperative in the stationary mode and operative in the supply mode.

5. A supply means according to claim 2, wherein the stationary enclosure of the magnetic systems defining the outflow opening merges, via a transition surface which extends at a continuous angle of inclination, into a straight outflow duct, and wherein the transition surface tangentially adjoins a part of the enclosure which forms the outflow opening and the outflow duct.

6. A supply means according to claim 2, wherein the stationary enclosure of the magnetic systems defining the outflow opening merges, via a straight transition plane having a constant angle of inclination, into a straight outflow duct, and wherein the straight transition plane tangentially adjoins a part of the enclosure forming the outflow opening.

7. A supply means according to claim 1, wherein the outflow opening is located beneath the reservoir in an operative state, and the direction of rotation of the magnetic systems in the supply mode is opposite the developing powder supply direction.

8. A supply means according to claim 7, wherein each magnetic system includes two diametrically opposed magnets on an outside thereof, said magnets extending parallel to the axis of rotation, and wherein a connecting line between the magnets of one of the magnetic systems is substantially perpendicular to a connecting line between the magnets of the other of the magnetic systems when a magnet is situated opposite the outflow opening.

9. A supply means according to claim 7, wherein the reservoir is provided with means contained therein for keeping the developing powder loose, said means being inoperative in the stationary mode and operative in the supply mode.

10. A supply means according to claim 7, wherein the stationary enclosure of the magnetic systems defining the outflow opening merges, via a transition surface which extends at a continuous angle of inclination, into a straight outflow duct, and wherein the transition surface tangentially adjoins a part of the enclosure which forms the outflow opening and the outflow duct.

11. A supply means according to claim 7, wherein the stationary enclosure of the magnetic systems defining the outflow opening merges, via a straight transition plane having a constant angle of inclination, into a straight outflow duct, and wherein the straight transition plane tangentially adjoins a part of the enclosure forming the outflow opening.

12. A supply means according to claim 1, wherein each magnetic system includes two diametrically opposed magnets on an outside thereof, said magnets extending parallel to the axis of rotation, and wherein a connecting line between the magnets of one of the magnetic systems is substantially perpendicular to a connecting line between the magnets of the other of the magnetic systems when a magnet is situated opposite the outflow opening.

13. A supply means according to claim 12, wherein in the stationary mode, one of the magnets is situated opposite the toner outflow opening.

14. A supply means according to claim 12, wherein the reservoir is provided with means contained therein for keeping the developing powder loose, said means being inoperative in the stationary mode and operative in the supply mode.

15. A supply means according to claim 13, wherein the reservoir is provided with means contained therein for keeping the developing powder loose, said means being inoperative in the stationary mode and operative in the supply mode.

16. A supply means according to claim 12, wherein the stationary enclosure of the magnetic systems defining the outflow opening merges, via a transition surface which extends at a continuous angle of inclination, into a straight outflow duct, and wherein the transition surface tangentially adjoins a part of the enclosure which forms the outflow opening and the outflow duct.

17. A supply means according to claim 12, wherein the stationary enclosure of the magnetic systems defining the outflow opening merges, via a straight transition plane having a constant angle of inclination, into a straight outflow duct, and wherein the straight transition plane tangentially adjoins a part of the enclosure forming the outflow opening.

18. A supply means according to claim 1, wherein the reservoir is provided with means contained therein for keeping the developing powder loose, said means being inoperative in the stationary mode and operative in the supply mode.

19. A supply means according to claim 1, wherein the stationary enclosure of the magnetic systems defining the outflow opening merges, via a transition surface which extends at a continuous angle of inclination, into a straight outflow duct, and wherein the transition surface tangentially adjoins a part of the enclosure which forms the outflow opening and the outflow duct.

20. A supply means according to claim 1, wherein the stationary enclosure of the magnetic systems defining the outflow opening merges, via a straight transition plane having a constant angle of inclination, into a straight outflow duct, and wherein the straight transition plane tangentially adjoins a part of the enclosure forming the outflow opening.

* * * * *